US007380670B2

(12) United States Patent
Paulson et al.

(10) Patent No.: US 7,380,670 B2
(45) Date of Patent: Jun. 3, 2008

(54) COMPACT DEDUSTING APPARATUS

(75) Inventors: Jerome I. Paulson, Lancaster, PA (US); Heinz Schneider, Lancaster, PA (US); Paul Wagner, Lancaster, PA (US)

(73) Assignee: Pelletron Corporation, Lancaster, PA (US)

( * ) Notice: Subject to any disclaimer, the term of this patent is extended or adjusted under 35 U.S.C. 154(b) by 165 days.

(21) Appl. No.: 11/454,437

(22) Filed: Jun. 16, 2006

(65) Prior Publication Data

US 2007/0289902 A1 Dec. 20, 2007

(51) Int. Cl.
*B07B 4/02* (2006.01)

(52) U.S. Cl. ..... 209/39; 209/133

(58) Field of Classification Search ..... 209/39, 209/133, 136, 137, 142, 145, 149, 477
See application file for complete search history.

(56) References Cited

U.S. PATENT DOCUMENTS

| | | | | | |
|---|---|---|---|---|---|
| 187,801 | A * | 2/1877 | Badger | 209/356 |
| 1,079,979 | A * | 12/1913 | Fletcher et al. | 209/151 |
| 1,509,913 | A * | 9/1924 | Stebbins | 209/474 |
| 2,667,969 | A * | 2/1954 | Bishop et al. | 209/34 |
| 3,669,264 | A * | 6/1972 | Bryant | 209/138 |
| 4,071,440 | A * | 1/1978 | Jedo et al. | 209/44 |
| 4,231,861 | A * | 11/1980 | Hannie et al. | 209/240 |
| 4,354,641 | A * | 10/1982 | Smith | 241/40 |
| 5,035,331 | A | 7/1991 | Paulson | 209/3 |
| 5,769,239 | A * | 6/1998 | Thom et al. | 209/240 |
| 6,595,369 | B2 | 7/2003 | Paulson | 209/149 |

* cited by examiner

*Primary Examiner*—Joseph C Rodriguez
(74) *Attorney, Agent, or Firm*—Miller Law Group, PLLC

(57) ABSTRACT

A compact housing for a dedusting apparatus utilizes a magnetic flux field to disrupt the static charge attracting dust particles to product particles, which along with fluidization and counter current airflow principles that are proven to dislodge dust particles from the product, provides a highly efficient, compact deduster. The housing supports a double wash deck with product flow separated between the back-to-back primary wash decks. A deflector directing the flow of product onto the primary wash decks is provided with an extension that extends parallel to the wash deck to eliminated product bouncing off of the wash deck. The lower air outlets are eliminated, while the upper air outlets are positioned in extensions to the main housing above the product inlet opening. Air flow through the Venturi zone is enhanced by re-directing clean air directly to the backside of the Venturi panels, thereby eliminating the extraneous by-pass boxes.

16 Claims, 10 Drawing Sheets

Fig. 10
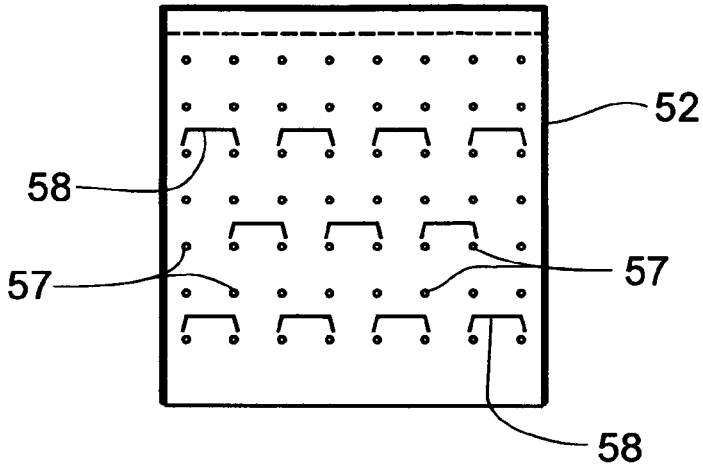
Fig. 11
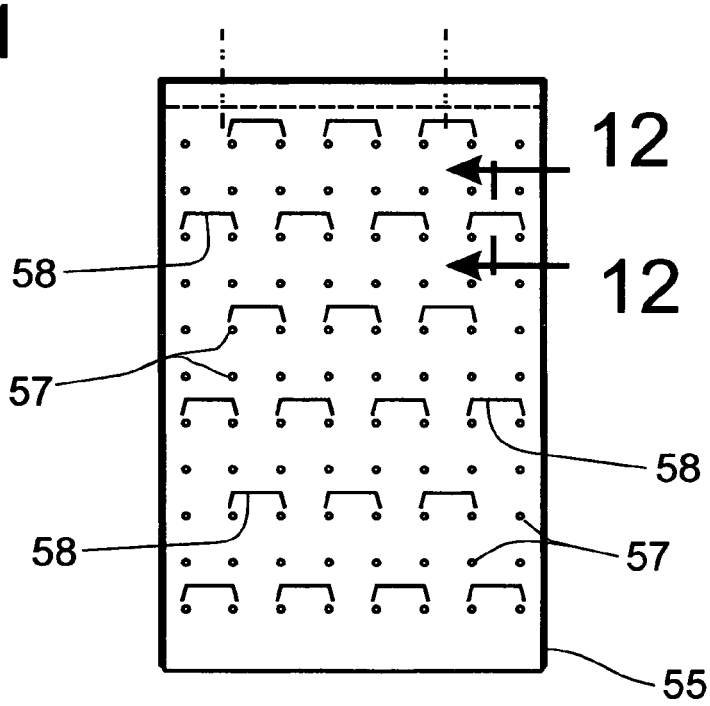
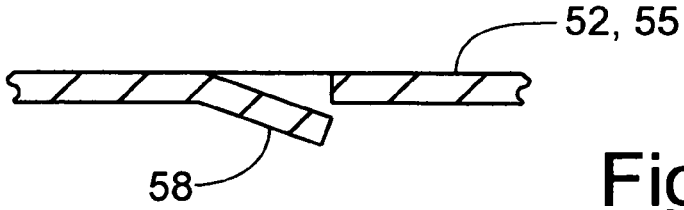
Fig. 12

COMPACT DEDUSTING APPARATUS

FIELD OF THE INVENTION

The invention disclosed in this application is directed generally to an apparatus for the cleaning and handling of particulate materials, such as plastic pellets, grains, glass, and the like, and particularly to the a low profile, compact apparatus that can be utilized in confined spaces without loss of efficiency.

BACKGROUND OF THE INVENTION

It is well known, particularly in the field of transporting and using particulate materials, commonly powders, granules, pellets, and the like, that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, streamers (ribbon-like elements that can "grow" into quite long and tangled), glass fibers in glass filled products, that can impede the flow of materials or even totally block the flow. The characteristics of such a transport system are quite well known, as is the importance and value of keeping product particles as free as possible of contaminants.

The term "contaminant" as used herein includes a broad range of foreign material and includes foreign material as well as broken particles or streamers of the product being transported. The generation of contaminants, also referred to as dust, can be from a large number of sources, including, in the way of examples, the creation of dust particles during the processing of plastic pellets in which the larger particles are segregated to be re-ground; organic matter in food grains, such as shells and hulls; the creation of dust in the formation of iron ore pellets; and, as noted previously, the mere conveyance of the pellets in pipes and other mechanical conveying and handling systems. Using plastics as an example, such foreign material could have a detrimental effect on the finished product. Specifically, foreign material different in composition from the primary material, such as dust, and non uniform material of the primary product, such as streamers, would not necessarily have the same melting temperatures as the primary product and would cause flaws when the plastics material is melted and molded.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and are, therefore, unsellable. It is important to note that since these same non-uniform materials often do not melt at the same temperature as the primary product, the unmelted contaminants cause friction and premature wear to the molding machines, resulting in downtime, lost production, reduced productivity, increased maintenance and thus increased overall production costs.

Since dust and other contaminants are generated mostly by the transport system, it is of primary importance to not only provide apparatus for thoroughly cleaning the particles, but to do so as close to the point of use of the particles as possible so as to avoid the generation of contaminants through additional transport. Accordingly, compact dedusters have been used for many years to clean materials in this application, capable of handling smaller volumes of product, yet also capable of thoroughly cleaning the product. The compact dedusters permit the installation of the deduster immediately before final use of the products, such as being installed directly on top of molding machines or extruders, or on top of silos, as well as under silos, rather than at an earlier stage after which re-contamination can occur before the products are utilized. Of course, the dedusters can be installed as a free standing unit, as well.

Dedusters used to clean contaminants from particulate material can be found in U.S. Pat. No. 5,035,331, granted to Jerome I. Paulson on Jul. 30, 1991, in which air is blown upwardly through wash decks over which a flow of contaminated particulate material is passed so that the flow of air up through the wash decks removes the contaminants from the material flow. A magnetic field is provided by the deduster so that the particulate material flow passes through the magnetic field to neutralize the static charge on the particulates and facilitate the removal of the contaminants from the material. The flow of contaminant laden air is discharged from the deduster, while the cleaned particulate material is passed on to the manufacturing process.

A compact dedusting apparatus is disclosed in U.S. Pat. No. 6,595,369, granted on Jul. 22, 2003, to Jerome I. Paulson. Like the larger dedusting apparatus depicted in U.S. Pat. No. 5,035,331, the follow of particulate material is cleansed of contaminates that have had the static charged attracting the contaminates to the particulates neutralized. The cleaning process utilizes a flow of air passing through the stream of particulate material passing over wash decks. The contaminate-laden air is discharged through the top of the dedusting apparatus, while the cleaned particulate material is discharged from the bottom of the deduster.

These compact dedusters are provided with a single wash deck bathed in a magnetic flux field to provide dual action cleaning that fluidizes the flow of particles over the wash deck and uses a counter current flow to dislodge dust particles from the product for discharge from the apparatus. The magnetic flux field extends on opposing sides of the magnetic flux field generator, as well as above and below the magnet. Accordingly, a single wash deck is utilizing only a quarter of the magnetic flux filed that is generated. Furthermore, a single wash deck is limited in capacity. A double wash deck configuration is known from the Pelletron Max Series dedusters, wherein back to back wash decks are provided with a lower dust air outlet having a deflector panel to minimize the inadvertent discharge of cleaned particles with the dust-laden air being discharged from the lower air outlets.

The discharge of dust-laden air through the upper air discharge openings is a limiting factor to the capacity of the compact deduster to clean particles. If the velocity of the air passing through the wash decks and through the Venturi zone is too great, cleaned particles will be carried over into the discharged air flow. Thus, deflectors have been provided in an attempt to minimize product carryover and air velocity is closely controlled. The compact dedusters disclosed in the aforementioned Paulson patents represent a compact package in which highly efficient particle dedusting operations are conducted; however, some commercial or industrial applications for the dedusters require yet a smaller compact design, which exacerbates the aforementioned problems of capacity, carryover, and air velocity.

Accordingly, it would be desirable to provide a dedusting apparatus that is more compact than previously known without sacrificing capacity and preferably improving cleaning efficiencies.

SUMMARY OF THE INVENTION

It is an object of the invention to overcome the disadvantages of the prior art by providing a compact dedusting apparatus that has improved air flow characteristics for the inlet of clean air into the housing and the discharge of dirty air from the housing.

It is another object of this invention to provide an effective compact dedusting apparatus that can thoroughly clean a flow of particulate material of dust particles and other contaminants immediately prior to the particulate material being used.

It is still another object of this invention to provide an enhanced wash deck configuration to increase the capacity of a compact dedusting apparatus.

It is an advantage of this invention that the size of the housing of the compact deduster is reduced, while increasing the capacity of the unit by using a higher loading of particulates through the Venturi zone.

It is a feature of this invention that the air outlets are positioned in extensions to the main housing.

It is another advantage of this invention that the distance from the wash decks to the air outlet openings are established to minimize product carryover without deflector panels.

It is another feature of this invention that a double wash deck configuration is utilized to increase operating capacities.

It is still another advantage of this invention that the double wash deck does not require a lower air outlet.

It is yet another feature of this invention that the flow of air through the Venturi zone is enhanced It is still another feature of this invention that the inlet air path is directed from the back of the housing to the backside of the Venturi panel.

It is yet another advantage of this invention that the by-pass box on the sides of the deduster housing can be eliminated to further minimize the size of the deduster housing.

It is a further feature of this invention that air slots are installed in the underside of the split wash deck to increase air flow in the Venturi zone.

It is a further advantage of this invention that granular materials with heavy dust contamination can be cleaned efficiently.

It is still a further feature of this invention that the inlet deflector directing the flow of product onto the primary wash decks includes a portion of the deflector panel oriented parallel to the wash decks.

It is still a further advantage of this invention that the deflector smoothes the flow of product onto the primary wash deck by eliminating the bouncing of the product particles off the primary wash deck.

It is a further object of this invention to provide a compact dedusting apparatus with improved air flow and a double wash deck to enhance capacity, which is durable in construction, inexpensive of manufacture, carefree of maintenance, facile in assemblage, and simple and effective in use.

These and other objects, features and advantages are accomplished according to the instant invention by providing a compact housing for a dedusting apparatus utilizing a magnetic flux field to disrupt the static charge attracting dust particles to product particles, which along with fluidization and counter current airflow principles that are proven to dislodge dust particles from the product, provides a highly efficient, compact deduster. The housing supports a double wash deck with product flow separated between the back-to-back primary wash decks. A deflector directing the flow of product onto the primary wash decks is provided with an extension that extends parallel to the wash deck to eliminated product bouncing off of the wash deck. The lower air outlets are eliminated, while the upper air outlets are positioned in extensions to the main housing above the product inlet opening. Air flow through the Venturi zone is enhanced by re-directing clean air directly to the backside of the Venturi panels, thereby eliminating the extraneous by-pass boxes.

BRIEF DESCRIPTION OF THE DRAWINGS

The advantages of this invention will become apparent upon consideration of the following detailed disclosure of the invention, especially when taken in conjunction with the accompanying drawings wherein:

FIG. 10 is a detail view of the inclined surface of the first wash deck;

FIG. 11 is a detail view of the inclined surface of the second wash deck; and FIG. 12 is a partial cross-sectional view of the slots in the wash decks corresponding to lines 12-12 of FIG. 11.

DETAILED DESCRIPTION OF THE PREFERRED EMBODIMENT

Figure 1:
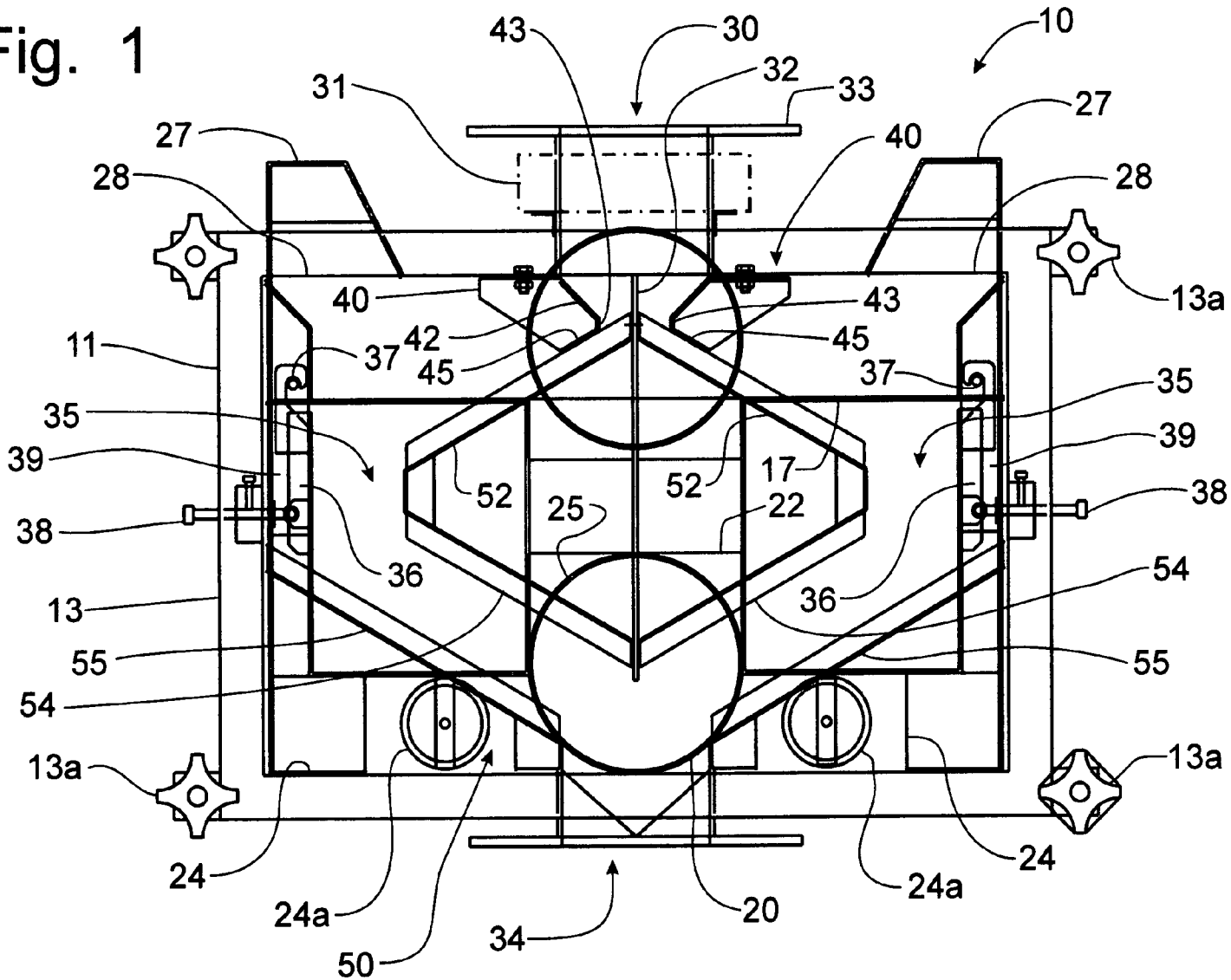
FIG. 1 is a front elevational view of a compact dedusting apparatus incorporating the principles of the instant invention, the magnetic coil being shown in phantom.
Figure 2:
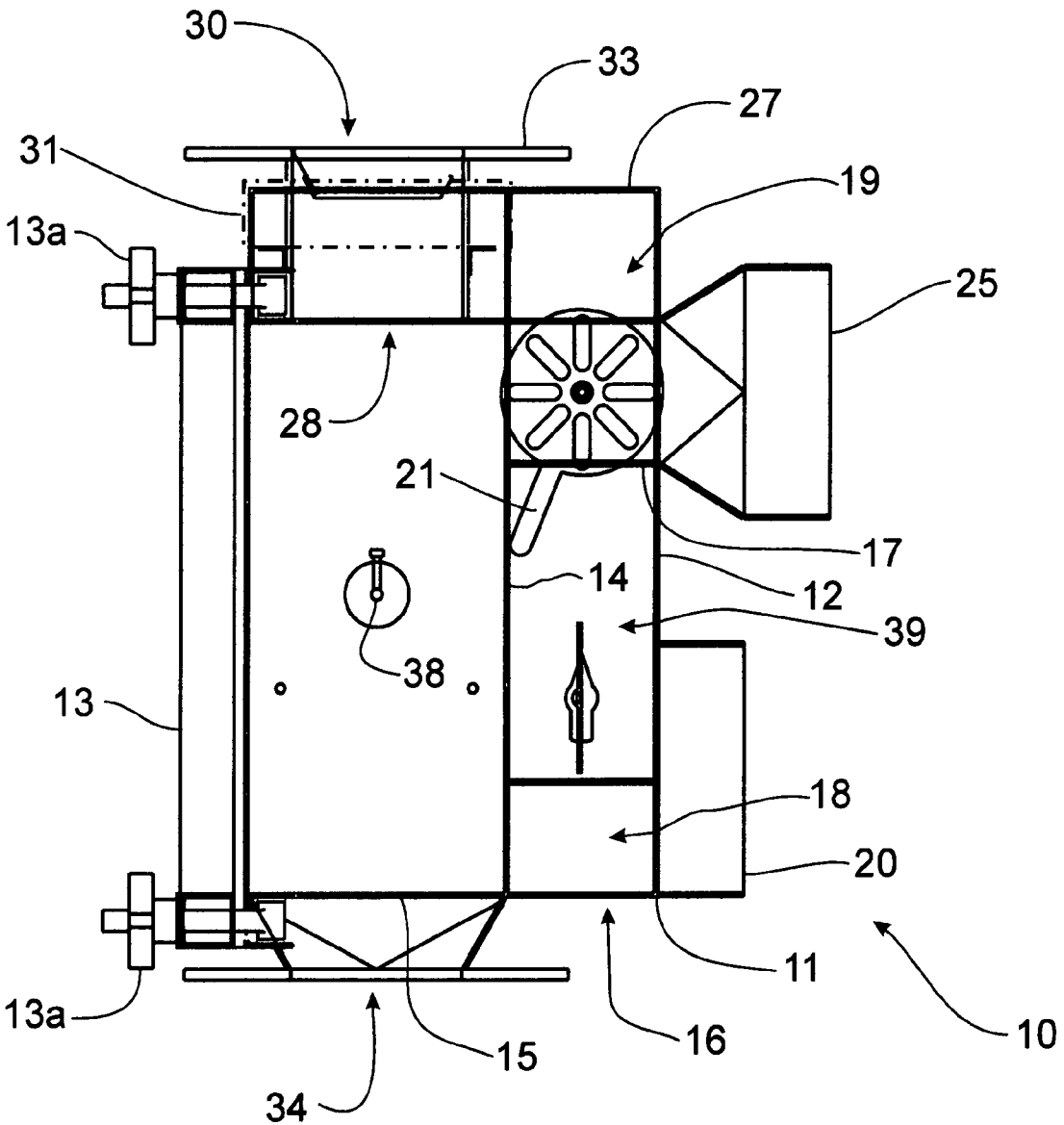
FIG. 2 is a side elevational view of the compact dedusting apparatus depicted in FIG. 1.
Figure 3:
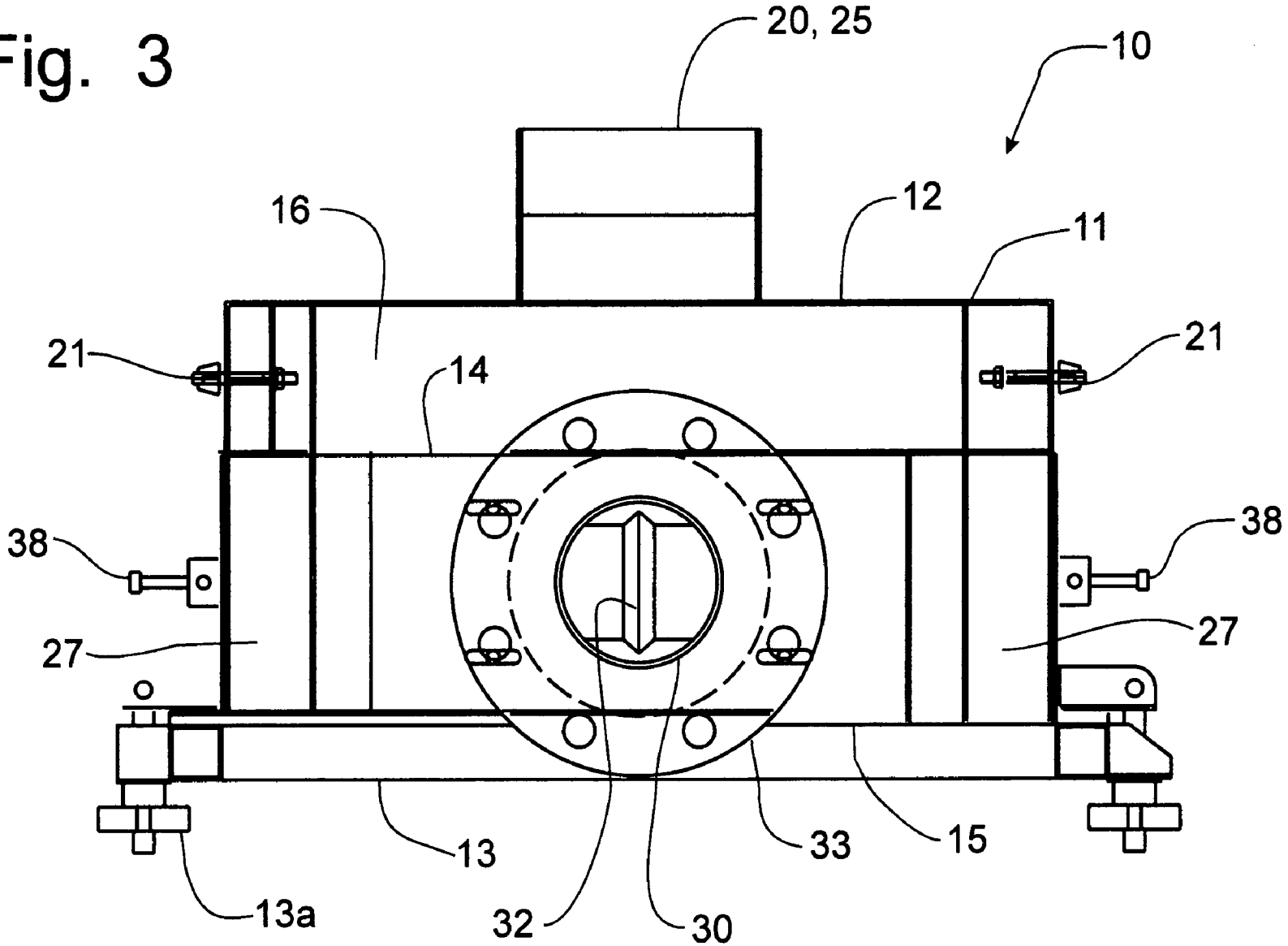
FIG. 3 is a top plan view of the compact dedusting apparatus depicted in FIG. 1.
Figure 4:
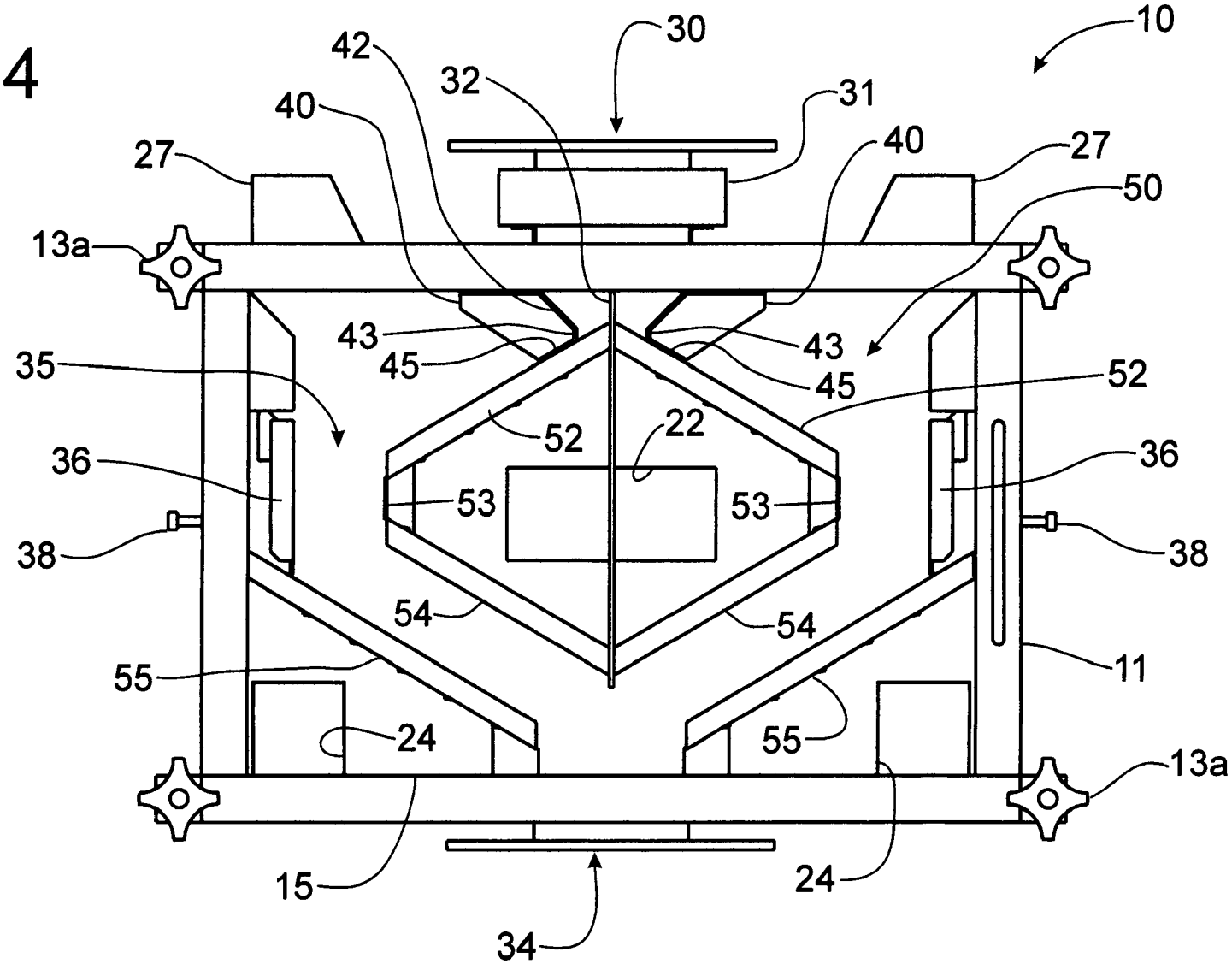
FIG. 4 is a partial front elevational view of the compact dedusting apparatus showing the arrangement of the wash decks and Venturi zones for cleaning dust particles from a flow of product over the wash decks.
Figure 5:
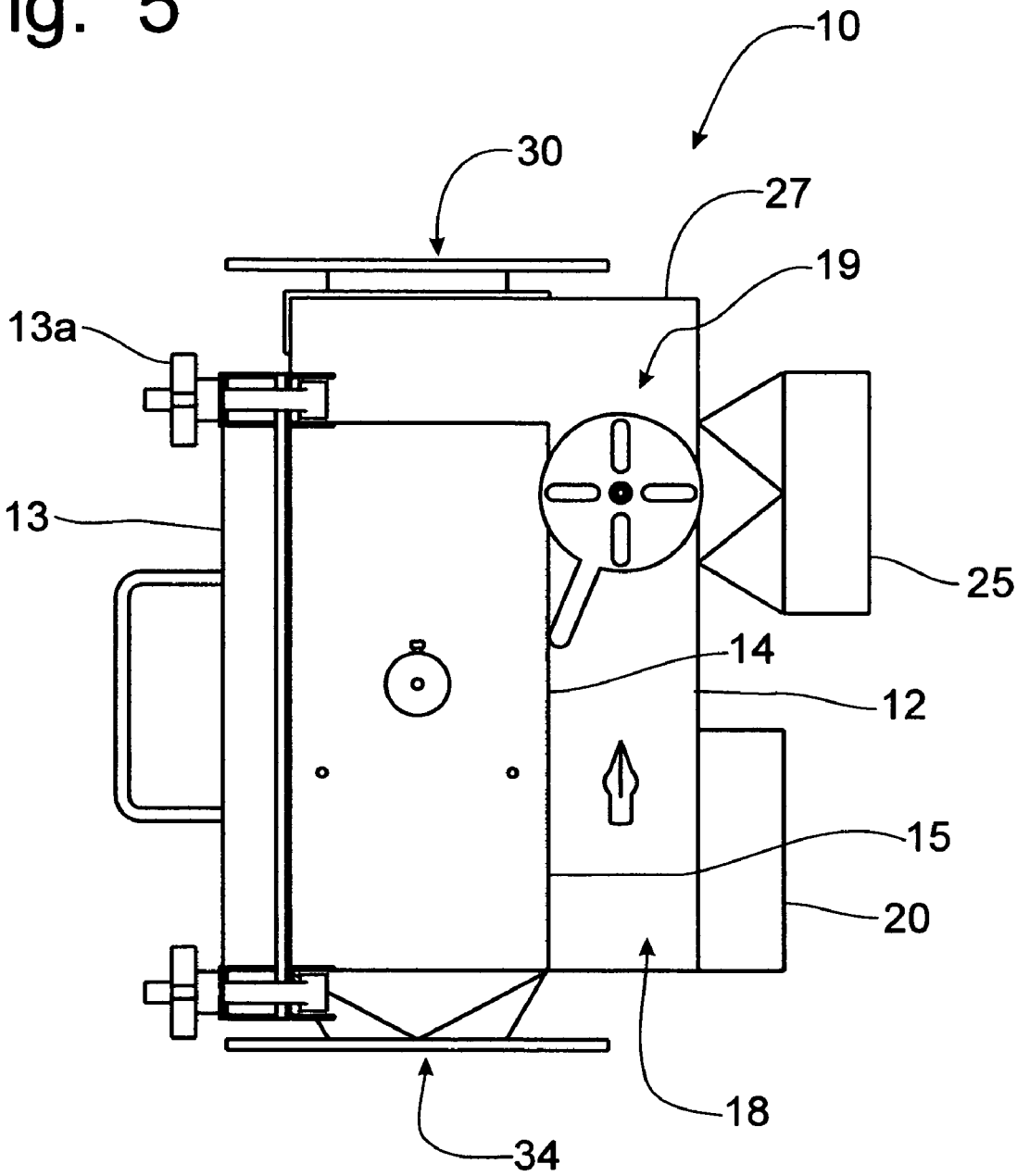
FIG. 5 is a side elevational view of the housing for the compact dedusting apparatus reflecting the division of the sections for the clean air, dusty air and cleansing operations.
Figure 6:
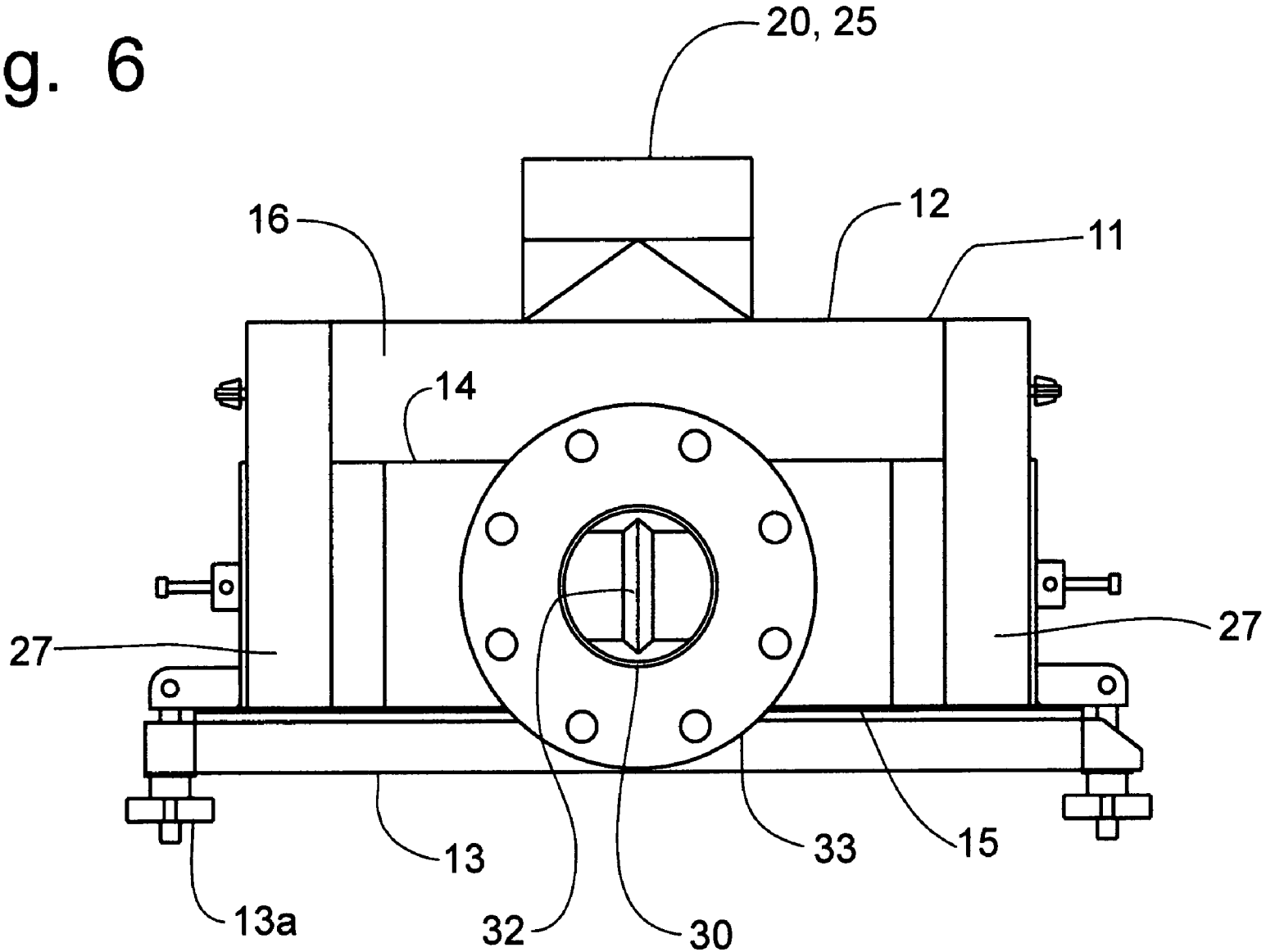
FIG. 6 is a top plan view of the housing depicted in FIGS. 4 and 5 showing the discharge path of the dusty air and the inlet of the dirty product.

The dedusting apparatus is known in the art. A description of the structure and operation of a dedusting apparatus and a compact dedusting apparatus can be found in U.S. Pat. No. 5,035,331 and in U.S. Pat. No. 6,595,369, both of which were issued to Jerome I. Paulson, the contents of each of these patents being incorporated herein by reference. Typical particulate material to be cleaned by the dedusting apparatus 10 is plastic pellets that are to be passed into an injection molding machine to form plastic components. Examples of plastic particulate material that can be cleaned of contaminate material by the dedusting apparatus 10 are polyester, acrylic, high density polyethylene, polypropylene, nylon, polycarbonates, styrene, and low density polyethylene. Other types of particulate material that can be cleaned in the dedusting apparatus 10 include glass particles and grain.

Referring to FIGS. 1-9, the dedusting apparatus 10 is connected to a vertical portion of a fluent material handling system (not shown) such that the particulate material is fed into a product inlet port 30 located at the top of an airtight casing 11. The casing 11 has two subcomponents, a main housing 15 in which the wash decks apparatus 50, as described below, is mounted, and an air flow passageway 16 primarily located behind the main housing 15. The product inlet port 30 is in flow communication with the main housing 15 to direct product particulates onto the first wash deck 52 for cleaning. A magnetic coil 31 generating a flux field is mounted at the inlet port 30 so that the flow of particulate material into the housing 15 to be cleaned is subjected to the magnetic flux field to neutralize the static charges on the particulate pellets, thus making the separation of the contaminates from the pellets easier to accomplish. Air is fed into the casing 11 through a clean air inlet port 20 located in the lower part of the back of the casing 11. As will be described in greater detail below, the air is distributed through from the clean air plenum 18 through internal passages to a first inlet opening 22 below the first wash decks 52 and to a second inlet opening 24 below the second wash decks 55.

The casing 11 is formed with a back panel 12, in which the clean air inlet port 20 and the dusty air discharge port 25 are located, and integral side, top and bottom panels that form a generally rectangular configuration. A removable front door 13 is connected to the remainder of the casing 11 by fasteners 13*a* to permit access into the wash deck apparatus 50 for service and maintenance thereof. An interior panel 14 oriented parallel to the back panel 12 and the front door 14 divides the casing 11 into a main housing 15 situated between the interior panel 14 and the front door 13 and an air flow passageway 16 situated between the back panel 12 and the interior panel 14. A separator panel 17 divides the air flow passageway into a lower clean air plenum 18 and an upper dusty air plenum 19, each of which being in flow communication with the respective clean air port 20 and the dusty air port 25.

The configuration of the wash deck apparatus 50 is in a double set, oriented back-to-back such that the first wash decks 52 are angled downwardly at an incline of approximately 30 degrees from the horizontal in opposing transverse directions. The second wash decks 55 are positioned beneath the first wash decks 52 so as to receive the flow of product particles therefrom, as will be described in greater detail below, and convey the product over an inclined surface that is also oriented at about a 30 degree incline relative to the horizontal. The first wash decks 52 are formed in a central diamond-shaped assembly that includes a lower deck member 54 associated with each of the first wash decks 52 and connected thereto by a generally vertically extending portion 53. The lower deck members 54 help define an air flow path that directs air transversely outwardly into Venturi zones 35 through which air is directed in a counter current flow to aggressively remove dust particles from the product.

Product to be cleaned is introduced into the housing 15 through the product inlet opening 30 at the center of the top portion of the housing 15. The magnetic coil 31 is positioned around the product inlet port 30 to introduce a magnetic flux field which covers the entire housing 15. Since the product flow needs to be divided equally between the back-to-back first wash decks 52, a divider 32 is positioned to split equally the product flow into two opposing transverse directions onto the first wash decks 52. A product inlet deflector 40 is positioned at the product inlet opening 30 on opposite sides of the divider 32 to direct the product inflow uniformly over the respective first wash decks 52. Each product inlet deflector 40 includes an inwardly directed member 42 that deflects the product toward the divider 32 to be spread evenly across the longitudinal width of the first wash deck 52. A vertical portion 43 connects the inwardly directed member 42 with an angled portion 45 that serves as an anti-jump device to prevent product particles that impact directly onto the wash deck 52 from bouncing off the deck 52 and heading upwardly toward the dusty air discharge opening 28. The anti-jump extension 45 thus reduces product carryover into the discharge of dusty air from the housing 15.

As can best be seen in FIGS. 10-30, the first air wash deck 52 and the second air wash deck 55 have a patterned array of holes 57 and slots 58, the holes 57 creating jets of air, which are directed substantially vertically through the product layer flowing over the wash decks 52, 55, causing the dust and streamers on the particulate product to be entrained in the air flow and be driven upwardly away from the particulate product. The slots 58 in the first air wash deck 52 provide a ribbon or sheet of air which accelerates the particulate product forwardly along the product path over the first air wash deck 52 toward the second wash deck 55, moving the individual particles at a speed greater than their terminal velocity. This increased velocity of the product permits use of higher counter current air velocity in the Venturi zone 35 resulting in improved cleaning efficiency.

The second air wash deck 55 is supported by the housing 15 in a downwardly directed incline opposite to that of the first air wash deck 52, though also oriented at a minimum angle of 30 degrees to the horizontal. In other words, the second wash decks 55 are angled from both opposing sides to direct a flow of product particles toward the center where the product discharge port 34 is located. Pressurized air is introduced into the second air wash deck 55 from the second inlet openings 24 in the interior panel 14 located beneath the second wash decks 55 to pass upwardly through the second air wash deck 55 similarly to that described above with respect to the first air wash deck 52 to clean any remaining contaminates from the flow of particulate product directed onto the second air wash deck 55.

The product particles moving off of the first wash deck 52 may have sufficient velocity, particularly due to the velocity boost generated by the ribbon of air passing through the slots 58, that the product particles may impact a generally vertical deflector plate 36 defining the outboard sides of the Venturi zones 35. Product deflected off of the deflector plates 36 are directed downwardly to the second air wash decks 55. The product discharge port 34 is provided at the center of the housing 15 between the two second wash decks 55 to receive product from the second wash decks 55 for discharge from the housing 15.

Air entering through the second inlet opening 24 is also directed behind the deflector plates 36, through an air flow chamber 39 that is in flow communication with the clean air plenum 18 beneath the second air wash decks 55, for use in adjusting the air flow in the Venturi zones 35. The air flow chamber 39 extends rearwardly into the clean air plenum 18 rearwardly of the interior panel 14 to deliver air above the second wash decks 55 and behind the deflector plates 36. The adjustment mechanism 38 is connected to each respective deflector plate 36 which is pivotally mounted about the longitudinally extending pivot 37 so that the bottom of each deflector plate 36 is movable into the corresponding Venturi zone 35 to permit a flow of air past the bottom of the deflector plates 36 into the Venturi zones 35 to increase the air flow through the Venturi zones 35. The air flow through the wash decks 52, 55 and through the Venturi zones 35 is directed upwardly toward the dusty air outlet openings 28.

Higher velocity of air moving through the Venturi zones 35 results in a greater counter current flow cleaning action to remove dust particles from the product. The higher the velocity of the air is, the greater the chance of product particles being trapped in the air flow and being carried up to the dusty air discharge opening 28. The vertical distance between the first wash deck 52 and the dusty air discharge opening 28 needs to be as large as possible, which is counter to the design goal of providing a compact deduster apparatus 10. Accordingly, the casing 11 is formed with a pair of extensions 27 located on opposing ends of the casing 11 that project above the rectangular casing 11 into which the dusty air discharge openings 28 are formed. The extensions 27 are in flow communication with the main housing 15 to allow dusty air to flow upwardly through the dusty air discharge openings 28 into the extensions 27 then rearwardly and then downwardly behind the main housing 15 into the dusty air plenum 19 forming the upper portion of the passageways 16 to reach the dusty air discharge port 25 at the back of the casing 11.

By directing the clean air from the inlet port 20 into the clean air plenum 18, air can be introduced under pressure to the first air wash decks 52 through the first inlet opening 22 centrally located within the diamond-shaped wash deck configuration below the first wash decks 52, and to the second wash decks 55 through laterally spaced second air inlet openings 24 positioned beneath the second wash decks 55, as is indicated by air flow arrows 61-63 in FIGS. 7-9. The portion of the clean air plenum 18 below the second wash decks 55 extends upwardly behind the deflector plates 36 to add air flow into the Venturi zones 35 as needed through adjustment of the pivoted deflector plates 36. This arrangement of the clean air plenum 18 eliminates the need to have a by-pass box mounted on the side of the casing 11 to direct air flow into the Venturi zones 35.

Figure 7:
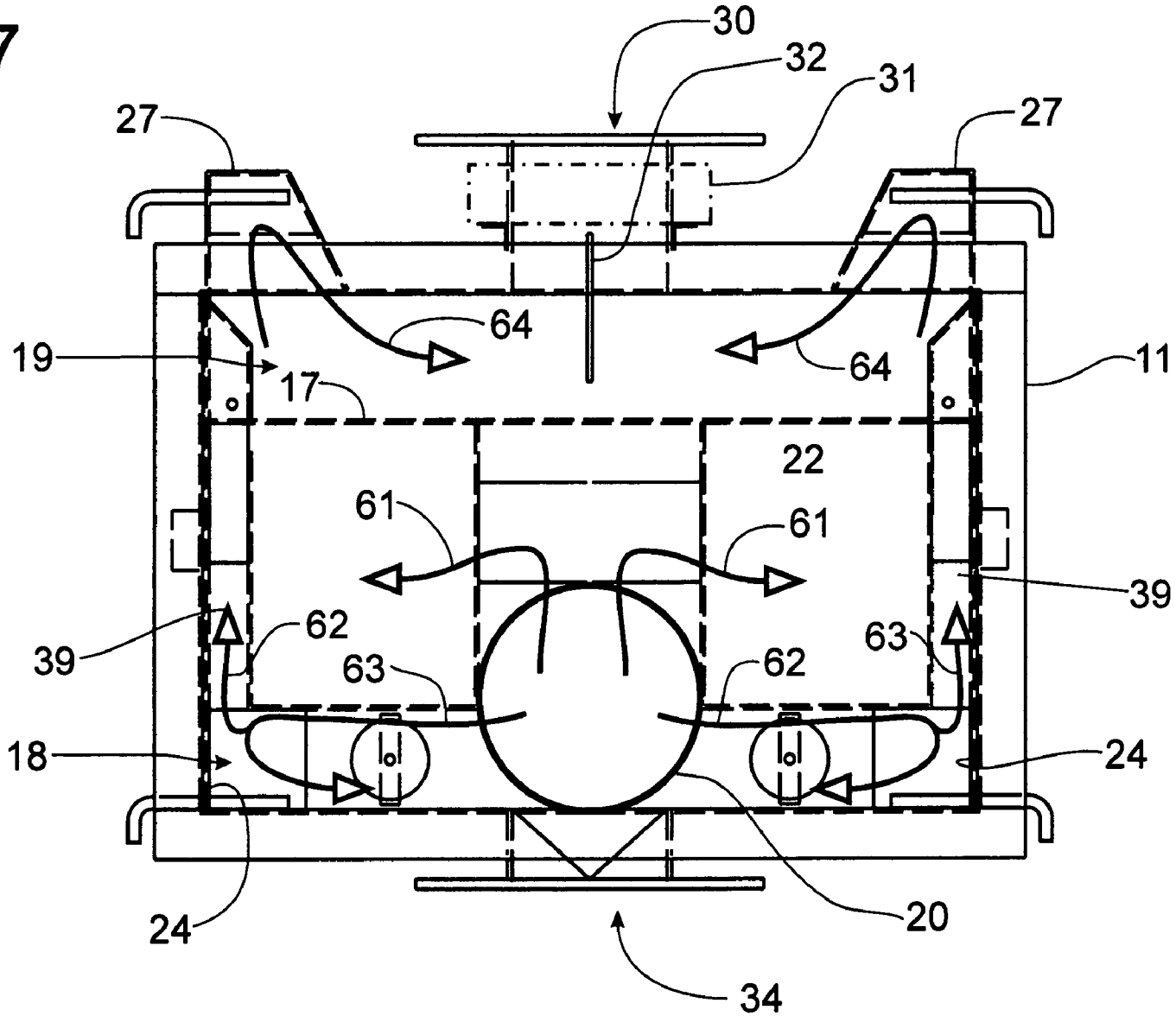
FIG. 7 is a front elevational view of the compact dedusting apparatus with the wash decks removed to better view the flow path of clean air inputted into the housing.
Figure 8:
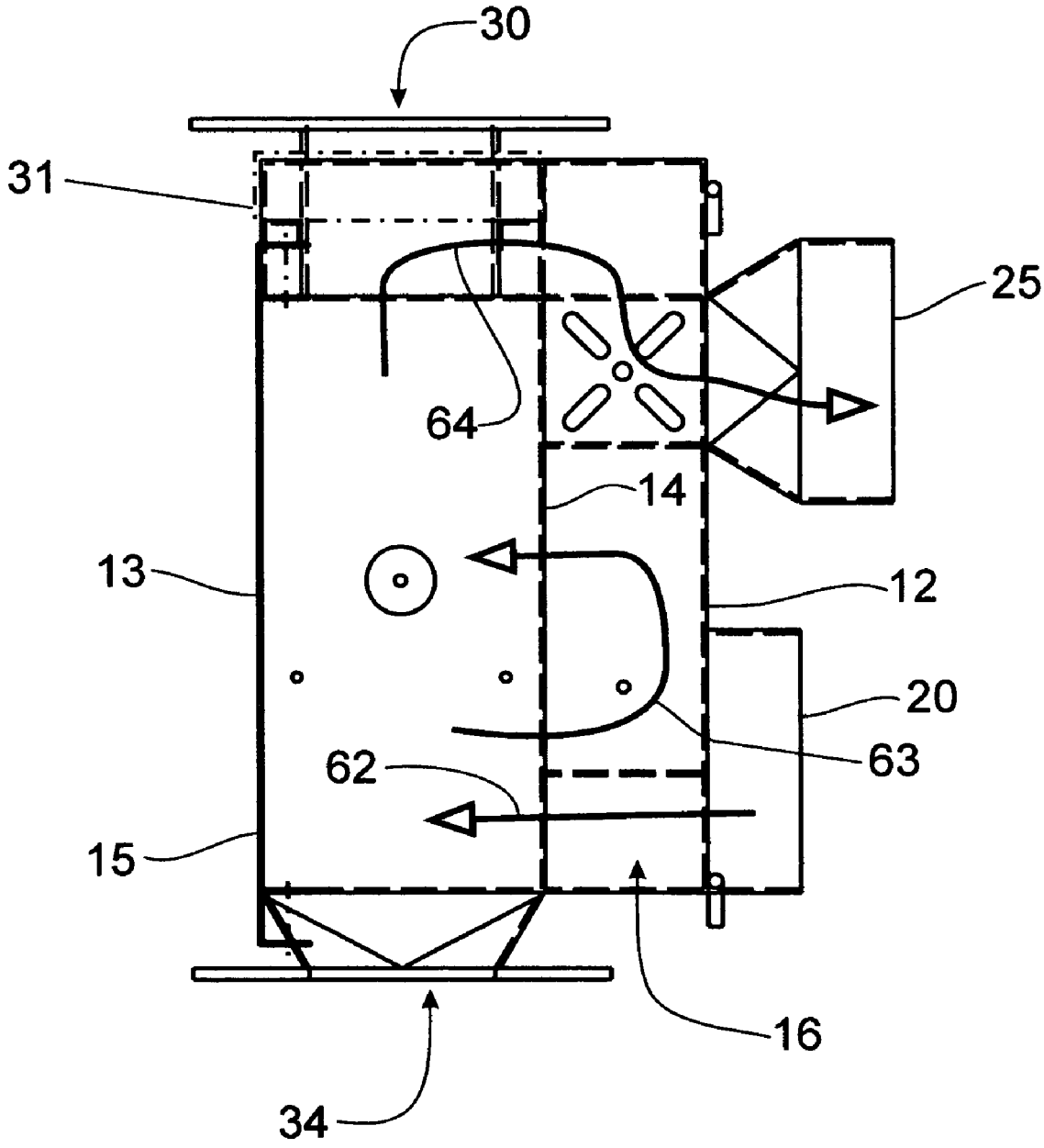
FIG. 8 is a side elevational view of the housing corresponding to FIG. 7 to better view the clean air flow path and the dusty air flow path through the housing.
Figure 9:
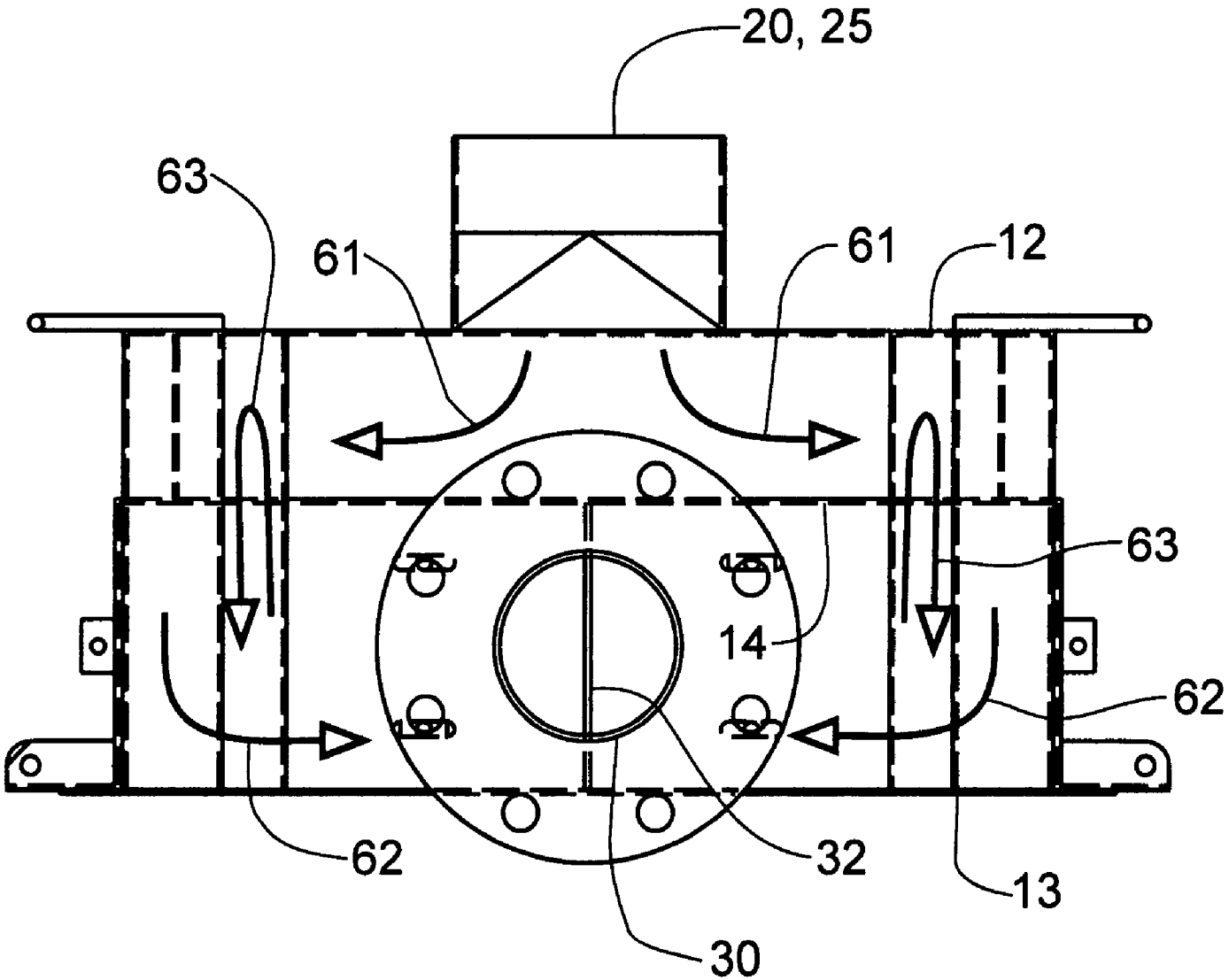
FIG. 9 is a top plan view of the housing depicted in FIG. 8.

The dusty air discharge path, represented by air flow arrows 64 in FIGS. 7-9, passes into housing extensions 27 positioned at the outside top corners of the casing 11 to provide a dusty air discharge opening 28 in the main housing 15 that is separated sufficiently from the first wash decks 52 to prevent product carryover, especially with respect to smaller product particulates within the product flow through the apparatus 10. The utilization of the housing extensions 27 enable the casing 11 to maintain a lower profile, as the housing extensions 27 are positioned above the casing 11, above the product inlet opening 34 into the main housing 15, and laterally of the magnetic coil 31, but below the mounting flange 33 that connects the apparatus 10 to the external line delivering product to the apparatus 10. Thus, the dusty air flow path, represented by the air flow arrows 64, exits the main housing 15 through a discharge opening 28 at the opposing upper, outboard extremities thereof, then upwardly and rearwardly through the housing extensions 27, and then back down into the dusty air plenum 19 for discharge from the casing 11 through the port 25.

In operation, the dedusting apparatus 10 receives a volume of contaminated particulate material to be cleaned which is introduced into the product inlet port 30. The particulate material passes through the magnetic flux field generated by magnetic coil 31 to disrupt the static charge attraction causing the contaminates to adhere to the individual particles of the particulate material. Material flow control is important in order to cause particulate particles to disperse in such a way that air can flow freely through the product stream so as to lift contaminants upward away from the product. The flow of material through the dedusting apparatus 10 is controlled by the inlet deflector members 40 and divided into laterally opposing flow paths by the divider 32 to drop onto the first air wash decks 52. Preferably, the product inlet deflectors 40 and the divider 32 are positionally adjustable to optimize the flow characteristics of the particulate material being fed into the apparatus 10.

If the layer of particulate material on the first air wash deck 52 is too thick, air may prevented from passing efficiently through the particulate material to separate out the contaminates. If the layer of particulate material is too thin, the air flow will not be efficiently utilized. The divider 32 must be also positioned properly to divide the product flows to the opposing first air wash decks 52. If one side of the wash deck apparatus 50 gets overloaded, as compared to the opposite side, the air flow through the wash deck apparatus 50 will seek the path of least resistance and move away from the overloaded side of the wash deck apparatus 50, thus reducing the cleaning operation of the apparatus 10.

Pressurized air flows through the holes in first air wash deck 52 to separate the contaminates from the individual pellets of product material, the contaminate particles being smaller and lighter than the product particulates. The air flow through slots 58 accelerates the partially cleaned product toward deflector plate 36. This partially cleaned particulate product then passes from the first wash decks 52 toward the corresponding second wash decks 55 and passes through a higher velocity counter air flow in the Venturi zones 35 passing upwardly on each opposing side of the wash deck apparatus 50 from the second air wash deck 55 through the narrowed opening between the vertical member 53 of the first air wash desk 52 and the deflector plate 36. The particulate product then falls onto the second air wash decks 55 for a further separation of contaminates from the particulate product. The lower deck members 54 direct the air passing through the second air wash decks 55 and the layer of particulate material thereon into the respective Venturi zones 35 as defined above. Lower dusty air discharge openings are not utilized, and thus special air deflector members are not necessary to prevent product carryover from the second air wash decks 55, to increase the air flow through the respective Venturi zones 35.

The first air wash deck 52 separates small particles of 100 microns and less from the flow of particulate material thereon. The Venturi zones 35 (between the first air wash decks 52 and the deflector plates 36), when adjusted correctly, will remove larger contaminants, thereby providing a two stage separation of contaminants as large as 1/52 of an inch. The particulate material is then passed across the second air wash deck 55 with residual contaminates being separated at this time. Finally, the cleaned product drops to the bottom of the main housing 15 and is discharged out of the dedusting apparatus 10 through the product outlet port 34.

Because of the different characteristics of the various products that can be introduced into the apparatus 10 to be cleaned of dust particles, certain aspects of the apparatus are made adjustable, as is generally known in the art. For example, the positions of the product inlet deflectors 40 and the divider 32 are preferably positionally adjustable to evenly and equally distribute product flows to the opposing air wash decks 52, 55. The deflector plates 36 forming the outboard sides of the respective Venturi zones 35 are preferably positionally adjustable so as to both change the physical dimensions of the Venturi zones 35, which alone changes the velocity of the air flowing through the Venturi zones 35, but also adds air flow past the deflector plates 36 into the Venturi zones 35. Too much air and too great of a velocity for some products will increase the product carry-over into the dusty air discharge openings. Under typical operating circumstances, the preferable pressure differential between the Venturi zones 35 and the dusty air discharge openings 28 is equal to about five inches of water.

A clean air adjustment valve 21 is provided at the top of the clean air plenum 18 to control the volume and pressure of the clean air flow being introduced into the apparatus 10 through the clean air inlet port 20. Similarly, air bleed out disks 24*a* are provided in the clean air plenum 18 below the second air wash decks 55 to control the air flow through the second wash decks 55 and the air flow available to the Venturi zones 35 from behind the deflector plates 36.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

What is claimed is:

1. A dedusting apparatus for removing dust particles from particulate product material, comprising:

a casing having a back panel, a front panel and an interior panel dividing the casing into a main housing and an air plenum behind the main housing, said air plenum being divided by a separator panel into a clean air plenum and a dusty air plenum;

a wash deck apparatus supported in the main housing and including:

a pair of first wash decks mounted to be inclined downwardly and outwardly in opposing lateral directions from a central axis;

a pair of lower deck members connected respectively to said first wash decks and oriented downwardly and inwardly toward said central axis to form a generally diamond-shaped configuration;

a pair of second wash decks oriented generally parallel to said lower deck members and being positioned respectively below said first wash decks to receive a flow of product material discharged from said first wash decks, each of said first and second wash decks having a plurality of holes and slots therein for the passage of air therethrough as product flow on top of the respective wash deck; and a Venturi zone located at the end of each said first wash deck and bounded on each respective outboard side by a deflector plate;

a product inlet port connected in flow communication to said main housing at said central axis to introduce an inflow of particulate material to be cleaned to said first wash decks;

a product discharge port connected in flow communication to said main housing at said central axis between said second wash decks to receive particulate material from said second wash decks for discharge from said main housing;

a clean air inlet port connected in flow communication to said clean air plenum for the introduction of air under pressure into said clean air plenum, said clean air plenum having:

a first air inlet opening in said interior panel below said first wash decks and above said lower deck members to introduce a flow of air through said holes and slots in said first wash decks;

a pair of second air inlet openings in said interior panel below said second wash decks to introduce a flow of air through said holes and slots in said second wash decks; and a Venturi flow chamber extending from below each said second wash deck and projecting rearwardly through said interior panel and terminating above the respective said second wash deck behind the corresponding said deflector plate to deliver a flow of air behind said deflector plates to enhance air flow in said respective said Venturi zone.

2. The dedusting apparatus of claim 1 further comprising a magnetic flux field generator mounted on said product inlet port to create a magnetic flux field to disrupt any static charges attracting the dust particles to the product particles.

3. The dedusting apparatus of claim 1 further comprising a product deflector positioned on each side of said product inlet port to direct said product particulates onto said first wash decks, each said product deflector comprising:

an inwardly directed portion angled downwardly and inwardly toward said central axis to direct said product material toward a top portion of each respective said first wash deck; and an anti-jump member extending from said inwardly directed portion in respective downwardly and outwardly directions generally parallel to the corresponding said first wash decks to direct product material onto said corresponding first wash deck.

4. The dedusting apparatus of claim 3 wherein said wash deck apparatus further includes a divider positioned on said central axis and extending upwardly from said first wash decks toward said product inlet port to divide the product material introduced through said product inlet port into two flow paths corresponding to said two first wash decks.

5. The dedusting apparatus of claim 1 wherein said main housing is formed with a dusty air discharge opening located at a top portion of said main housing at the respective outboard extremities thereof to be located above said respective Venturi zones.

6. The dedusting apparatus of claim 5 further comprising a pair of housing extensions extending above said main housing at said dusty air discharge openings to create a flow path for said air to be discharged from said main housing in a path that extends above said product inlet opening into said main housing.

7. The dedusting apparatus of claim 6 wherein said housing extensions are in flow communication with said dusty air plenum, said dedusting apparatus further comprising a dusty air discharge port connected in flow communication with said dusty air plenum for the discharge of said air from said casing.

8. The dedusting apparatus of claim 7 wherein said front panel of said main housing is detachably mounted to said main housing by removable fasteners to permit access into said wash deck apparatus.

9. The dedusting apparatus of claim 1 wherein said deflector plates are pivotally mounted and connected to an adjustment mechanism operable to control a pivoted position of each respective said deflector plate to control a flow of air past said deflector plates into the corresponding said Venturi zone.

10. A wash deck apparatus for a particulate material deduster, comprising:

a housing having a product inlet port centrally located at a top portion thereof and a product outlet port centrally located at a bottom portion thereof;

a pair of first wash decks mounted to said housing to receive product introduced through said product inlet port, said first wash decks being inclined downwardly and outwardly in opposing lateral directions from a central axis;

a pair of lower deck members connected respectively to said first wash decks and oriented downwardly and inwardly toward said central axis to form a generally diamond-shaped configuration;

a pair of second wash decks mounted to said housing and being oriented generally parallel to said lower deck members and being positioned respectively below said first wash decks to receive a flow of product material discharged from said first wash decks, each of said first and second wash decks having a plurality of holes and slots therein for the passage of air therethrough as product flow on top of the respective wash deck;

a Venturi zone located at the end of each said first wash deck and bounded on each respective outboard side by a deflector plate;

a clean air plenum operable to deliver air from a clean air inlet port to inlet openings below said first and second wash decks; and a dusty air plenum operable to discharge dusty air from said housing through a dusty air discharge opening above said first wash deck, said dusty air plenum being in flow communication with a dusty air discharge port, air passing through said second wash decks must pass through said Venturi zones to reach said dusty air discharge opening for discharge from said housing.

11. The wash deck apparatus of claim 10 wherein said clean air plenum includes:

a first air inlet opening in said housing below said first wash decks and above said lower deck members to introduce a flow of air through said holes and slots in said first wash decks;

a pair of second air inlet openings in said housing below said second wash decks to introduce a flow of air through said holes and slots in said second wash decks; and a Venturi flow chamber extending from below each said second wash deck and projecting rearwardly through said housing into said clean air plenum and terminating above the respective said second wash deck behind the corresponding said deflector plate to deliver a flow of air behind said deflector plates to enhance air flow in said respective said Venturi zone.

12. The wash deck apparatus of claim 11 wherein said dusty air discharge opening is located at a top portion of said main housing at each respective outboard extremity thereof to be located above said respective Venturi zones.

13. The wash deck apparatus of claim 12 further comprising a pair of housing extensions extending above said main housing at said dusty air discharge openings to create a flow path for said air to be discharged from said main housing in a path that extends above said product inlet opening into said main housing, said housing extensions being in flow communication with said dusty air plenum.

14. The wash deck apparatus of claim 13 further comprising a product deflector positioned on each side of said product inlet port to direct said product particulates onto said first wash decks, each said product deflector comprising:

an inwardly directed portion angled downwardly and inwardly toward said central axis to direct said product material toward a top portion of each respective said first wash deck; and an anti-jump member extending from said inwardly directed portion in respective downwardly and outwardly directions generally parallel to the corresponding said first wash decks to direct product material onto said corresponding first wash deck.

15. The wash deck apparatus of claim 14 wherein said wash deck apparatus further includes a divider positioned on said central axis and extending upwardly from said first wash decks toward said product inlet port to divide the product material introduced through said product inlet port into two flow paths corresponding to said two first wash decks.

16. The wash deck apparatus of claim 15 further comprising a magnetic flux field generator mounted on said product inlet port to create a magnetic flux field to disrupt static charges attracting the dust particles to the product particles.

* * * * *